US008006836B2

(12) United States Patent
Trombetta

(10) Patent No.: US 8,006,836 B2
(45) Date of Patent: Aug. 30, 2011

(54) UNCONTAMINATED GARMENT

(75) Inventor: Stephen S. Trombetta, West Chester, PA (US)

(73) Assignee: Veltek Associates, Inc., Malvern, PA (US)

( * ) Notice: Subject to any disclaimer, the term of this patent is extended or adjusted under 35 U.S.C. 154(b) by 350 days.

(21) Appl. No.: 11/898,357

(22) Filed: Sep. 11, 2007

(65) Prior Publication Data

US 2009/0065384 A1 Mar. 12, 2009

(51) Int. Cl.
*A41D 13/00* (2006.01)

(52) U.S. Cl. ..... 206/292; 2/243.1; 2/455; 206/278; 53/425

(58) Field of Classification Search ..... 206/278, 206/292, 278.1, 8, 11, 279, 280–287; 2/69, 2/114, 901, 269, 79; 53/425, 434, 449
See application file for complete search history.

(56) References Cited

U.S. PATENT DOCUMENTS

| | | | | |
|---|---|---|---|---|
| 3,359,569 | A * | 12/1967 | Scrivens et al. | 2/114 |
| 3,570,012 | A * | 3/1971 | Winters | 2/114 |
| 3,625,206 | A | 12/1971 | Charnley | |
| 3,721,999 | A | 3/1973 | Goya et al. | |
| 4,065,814 | A | 1/1978 | Fox | |
| RE30,520 | E | 2/1981 | Pierron et al. | |
| 4,523,335 | A * | 6/1985 | Scrivens | 2/51 |
| 4,783,854 | A * | 11/1988 | Bjorklund | 2/51 |
| 4,942,987 | A * | 7/1990 | Stackhouse | 223/37 |
| 5,074,444 | A * | 12/1991 | Cooper | 223/37 |
| 5,097,534 | A * | 3/1992 | Viemeister et al. | 2/69 |
| 5,770,529 | A | 6/1998 | Dennis et al. | |
| 5,862,525 | A * | 1/1999 | Tankersley et al. | 2/243.1 |
| 5,867,825 | A * | 2/1999 | Scheerer | 2/69 |
| 6,123,900 | A | 9/2000 | Vellutato | |
| 6,333,006 | B1 | 12/2001 | Vellutato | |
| 6,604,248 | B1 | 8/2003 | Brown | |
| 7,207,781 | B2 | 4/2007 | Shumway | |
| 2002/0064477 | A1 * | 5/2002 | Vellutato | 422/22 |
| 2004/0006815 | A1 * | 1/2004 | Carroll et al. | 2/457 |
| 2007/0084145 | A1 * | 4/2007 | Scheerer | 53/425 |
| 2009/0019622 | A1 * | 1/2009 | Mayfield et al. | 2/455 |
| 2009/0084695 | A1 * | 4/2009 | Vellutato et al. | 206/278 |

FOREIGN PATENT DOCUMENTS

WO WO-9633626 A1 10/1996

* cited by examiner

*Primary Examiner* — Anthony Stashick
*Assistant Examiner* — Cynthia Collado
(74) *Attorney, Agent, or Firm* — Blank Rome LLP

(57) ABSTRACT

A packaged garment includes a garment and a sealed bag. The garment has a torso portion, a sleeve portion connected to the torso portion, and a leg portion connected to the torso portion. The garment has an outer surface and an inner surface opposite the outer surface. The sealed bag contains the garment with the sleeve portion folded onto the torso portion and the leg portion folded onto the torso portion. The garment is manipulated so that the inner surface of the torso portion faces outward and the torso portion forms an inner space containing the sleeve portion and the leg portion.

36 Claims, 8 Drawing Sheets

UNCONTAMINATED GARMENT

FIELD OF THE INVENTION

The present invention relates to garments. In particular, the present invention relates to the packaging of garments to prevent contamination during donning of the garments.

BACKGROUND OF THE INVENTION

Garments free of contamination are required in particular situations, such as garments for clean rooms and sterilized procedures. A conventional uncontaminated garment is folded and packaged in a bag. Then, it is irradiated and delivered to the clean room. The bag prevents the garment from becoming contaminated prior to use. The garment is folded with its outer surface facing outward, and thus, the outer surfaces are exposed and subject to becoming contaminated if touched by the hands or body of the person donning the garment. Also, the outer surfaces can become contaminated if the garment contacts the floor or a wall during the donning process.

To don the conventionally packaged garment, the bag must be opened, and the user must look for an exposed inner surface of the garment. Then, the user must carefully grasp the inner surface so as not to touch (and thereby contaminate) the outer surface. This is done by grabbing the garment at a neck portion where a small amount of the inner surface is usually exposed. Next, the user must carefully manipulate the conventional uncontaminated garment to turn it inside out by slowly folding the garment down until the user's legs and arms can be inserted.

Because the donning of conventional uncontaminated garments requires extensive handling while donning, conventional uncontaminated garments are often contaminated during the donning process. Furthermore, to prevent contamination during the donning process, the wearer has to be specially trained in the proper method for donning the garment.

SUMMARY OF THE INVENTION

Accordingly, an aspect of the present invention is to provide a packaged uncontaminated garment that facilitates donning and use of the uncontaminated garment.

One embodiment of the present invention provides a packaged garment. The packaged garment includes a garment having a torso portion, a sleeve portion coupled to the torso portion, and a leg portion coupled to the torso portion, the garment having an outer surface and an inner surface opposite the outer surface; and a sealed bag containing the garment with the sleeve portion folded onto the torso portion, the leg portion folded onto the torso portion, and the folded garment manipulated so that the inner surface of the torso portion faces outward and the torso portion forms an inner space containing the sleeve portion and the leg portion.

Another embodiment of the present invention provides a method of manufacturing a package garment having an outer surface, an inner surface opposite the outer surface, a torso portion, two sleeve portions coupled to the torso portion at respective arm accesses, and two leg portions coupled to the torso portion at respective leg accesses. The method of manufacturing comprises the steps of: folding the two sleeve portions onto the torso portion; folding the two leg portions onto the torso portion; and manipulating the folded garment so that the inner surface of the torso portion faces outward with the two sleeve portions and the two leg portions within.

Yet another embodiment of the present invention provides a method of manufacturing a packaged uncontaminated garment having an outer surface, an inner surface opposite the outer surface, a torso portion with an opening, sleeve portions coupled to the torso portion at respective arm accesses, and leg portions coupled to the torso portion at respective leg accesses. The method of manufacturing comprises the steps of: folding the sleeve portions onto the torso portion; folding the leg portions onto the torso portion over the sleeve portions; manipulating the opening of the torso portion over the folded sleeve portions and leg portions so that the inner surface of the torso portion faces outward with the outer surface of the sleeve portions and the leg portions facing outward within the torso portion; fully extending the sleeve portions and the leg portions within the torso portion; and arranging arm accesses and leg accesses to lie substantially at an outer peripheral edge of the folded garment.

Other objects, advantages and salient features of the invention will become apparent from the following detailed description, which, taken in conjunction with the annexed drawings, discloses an exemplary embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-17, the present invention provides a packaged garment 10 and a method of packaging the garment 10 to prevent contamination while donning the garment 10.

Figure 1:
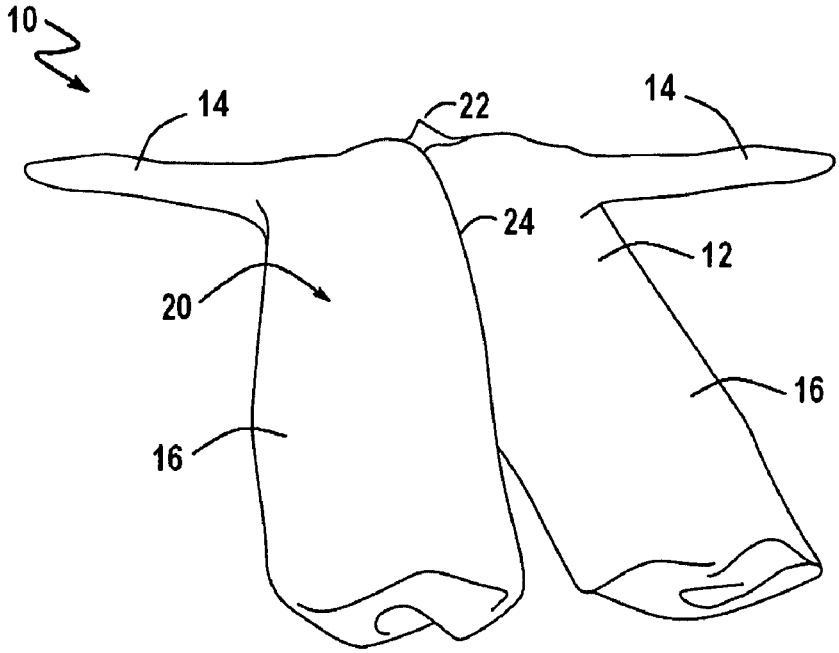
FIG. 1 is a perspective view illustrating the garment according to an embodiment of the present invention.

Referring to FIG. 1, a garment 10 is shown that is used with the invention. The garment is preferably of the type worn in a clean room and is a coverall that includes an outer surface 20, a torso portion 12, sleeve portions 14, and leg portions 16. The torso portion 12 covers, substantially or partially, the torso of a wearer. The torso portion 12 also has an opening 24 through which the wearer dons the garment 10. The opening 24 is substantially in the center of the torso portion 12 and extends in the longitudinal direction of the garment 10 from the neck to the top of the leg portions 16 to allow easy access for donning and removal. The opening 24 can be closed by zipper, Velcro, snap fasteners, clasps, buttons or other similar closing devices. The torso portion 12 can also include a collar portion 22 that is worn around the neck of the wearer. The sleeve portions 14 cover the arms of the wearer. The sleeve portions 14 can have an elastic cuff so that the sleeve portions 14 stay substantially in place with respect to the wearer's arm. Attached at the end of the sleeve portion 14 may be a loop that can be placed around the wearer's thumb to prevent the sleeve portion 14 from moving away from the wearer's wrist. The leg portions 16 cover the legs of the wearer. The leg portions 16 can also have an elastic cuff so that the leg portions 16 stay substantially in place with respect to the wearer's leg. Thus, the garment 10 substantially covers the entire body of the wearer, except the head, feet, and hands. However, the garment 10 may also include a hood portion (not shown), a glove portion (not shown), a boot portion (not shown), or any combination thereof. The hood portion, the glove portion, or the boot portion may be provided separately, attached to, or formed integrally with the garment 10.

Figure 2:
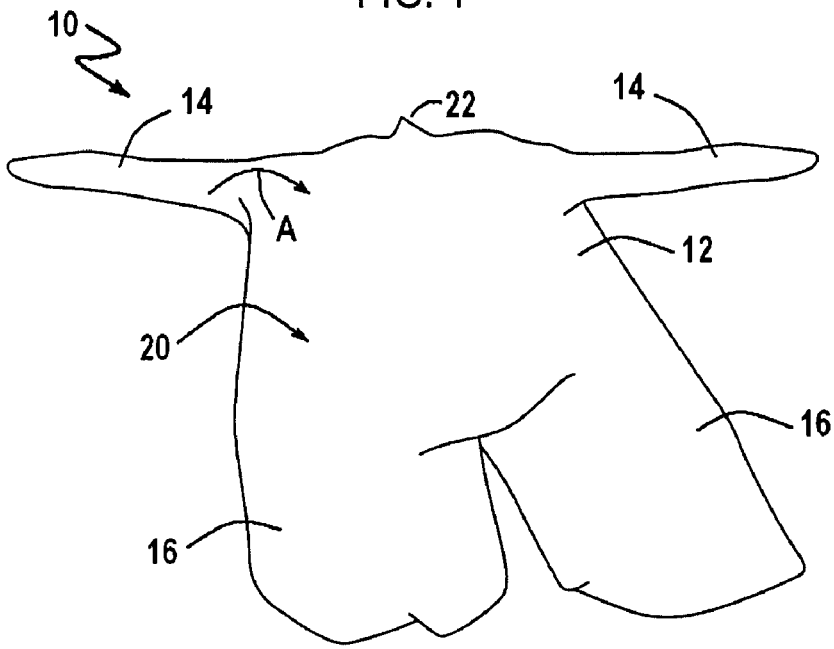
FIG. 2 is a perspective view of the garment illustrated in FIG. 1 showing a step in folding the garment.
Figure 3:
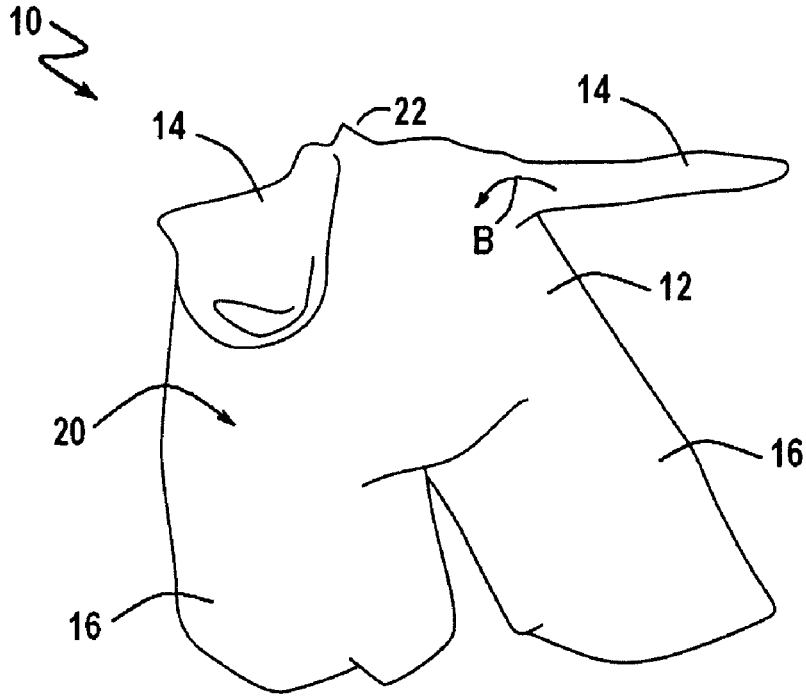
FIG. 3 is a perspective view of the garment illustrated in FIG. 1 showing a step in folding the garment.
Figure 4:
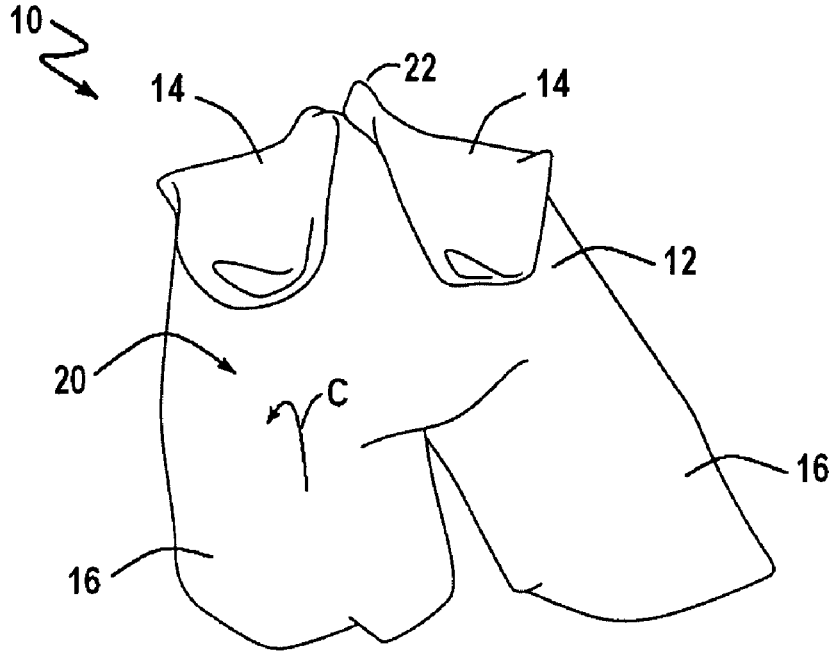
FIG. 4 is a perspective view of the garment illustrated in FIG. 1 showing a step in folding the garment.

Referring to FIGS. 2-13, a method for packaging the garment 10 for subsequent use is illustrated. At FIG. 2, the garment 10 is placed flat on a surface with the opening 24 facing down. Then, one sleeve portion 14 is folded inward and downward onto the torso portion 12 in the direction of arrow A, as shown in FIG. 2. The folded sleeve portion 14 is shown in FIG. 3. Next, the other sleeve portion 14 is folded inward and downward onto the torso portion 12 in the direction of arrow B, and the folded sleeve portion 14 is shown in FIG. 4. The sleeve portions 14 fold substantially along a line at which each of the sleeve portions 14 connect to the torso portion 12. After the sleeve portions 14 are folded, as shown in FIG. 4, the sleeve portions 14 lie substantially parallel to the longitudinal direction of the unfolded garment 10. The sleeve portions 14 can also be folded onto the torso portion 12 so that the sleeve portions 12 lie substantially perpendicular to the longitudinal direction of the torso portion 12.

Figure 5:
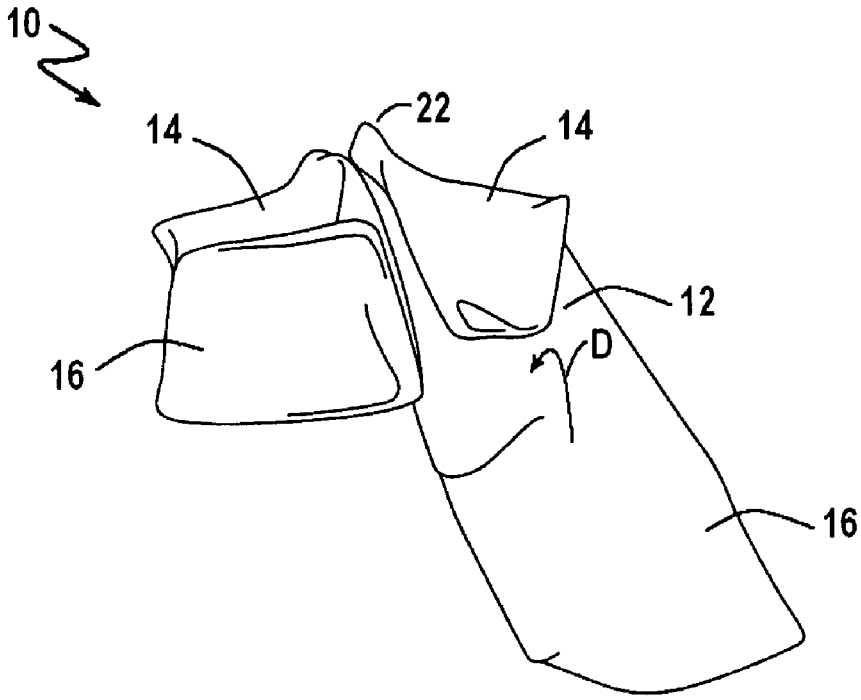
FIG. 5 is a perspective view of the garment illustrated in FIG. 1 showing a step in folding the garment.
Figure 6:
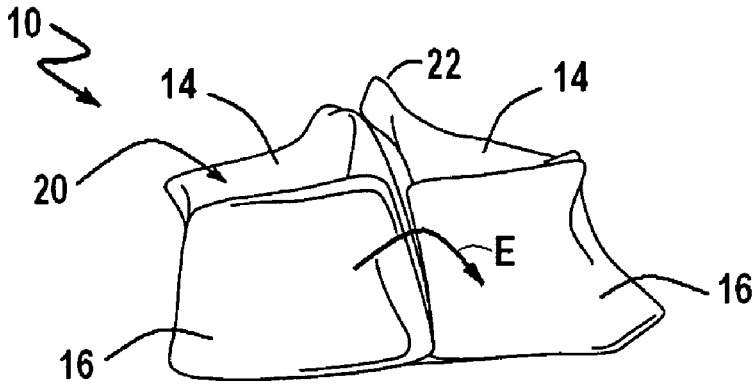
FIG. 6 is a perspective view of the garment illustrated in FIG. 1 showing a step in folding the garment.

After the sleeve portions 14 are folded, the leg portions 16 are then folded. One leg portion 16 is folded onto the torso portion 12 over the sleeve portion 14 in the direction of arrow C, as shown in FIG. 4. The folded leg portion 16 is shown in FIG. 5. Next, the other leg portion 16 is folded over the other sleeve portion 14 in the direction of arrow D, shown in FIG. 6. In FIG. 6, both of the leg portions 16 are folded so that the leg portions 16 lie substantially parallel to the longitudinal direction of the torso portion 12. The leg portions 16 fold substantially along a line at which each of the leg portions 16 connect to the torso portion 12. Then, the garment 10 is turned upside down.

Figure 7:
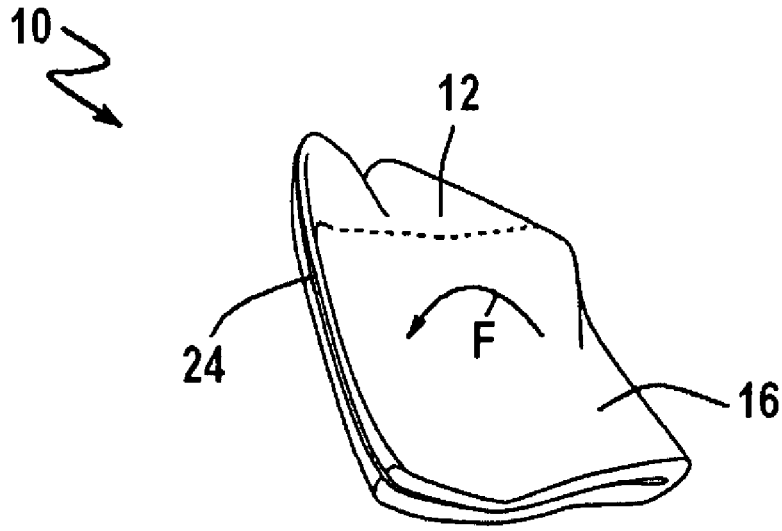
FIG. 7 is a perspective view of the garment illustrated in FIG. 1 showing a step in folding the garment.
Figure 8:
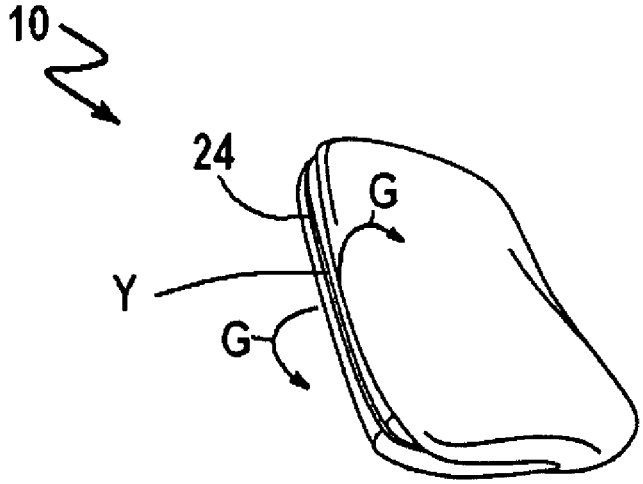
FIG. 8 is a perspective view of the garment illustrated in FIG. 1 showing a step in folding the garment.

Next, as shown in FIG. 6, preparatory folds are made so that the outer surface 20 of the torso portion 12 of the garment 10 faces inward. In one exemplary embodiment, the garment 10 is folded in half in the direction of arrow E. Thus, as shown in FIG. 7, the opening 24 lies substantially along an edge of the folded garment 10 with the leg portions 16 lying on top and underneath. In further preparation for folding the garment 10 inside out, the garment 10 can be optionally folded substantially in half along a line that is substantially parallel to the opening 24 in the direction of arrow F, as shown in FIG. 7. Then, as shown in FIG. 8, the edges of the opening 24 are separated from each other and the front sides of the torso portion 12 are pulled over the folded garment 10 in the direction of arrows G. Also, with the garment 10 folded as shown in FIG. 8, an exposed part Y in the middle of the back of the torso portion 12 can be grasped to maintain the sleeve portions 14 and leg portions 16 in place while pulling the front sides of the torso portion 12 over the garment 10 in the direction G. At the same time, the sleeve portions 14 and the leg portions 16 are folded within the torso portion 12.

Figure 9:
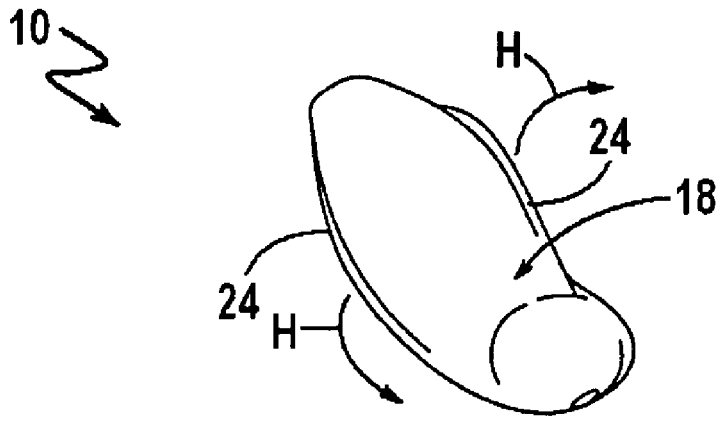
FIG. 9 is a perspective view of the garment illustrated in FIG. 1 showing a step in folding the garment.
Figure 10:
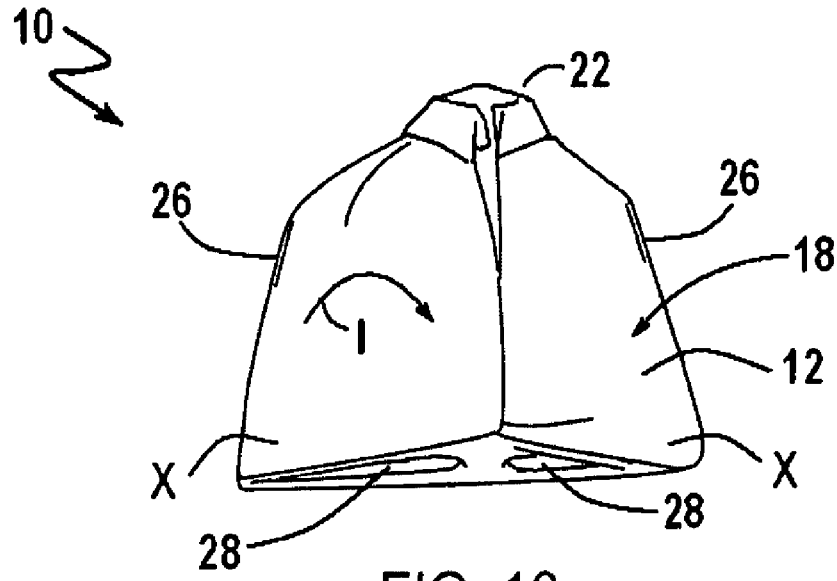
FIG. 10 is a perspective view of the garment illustrated in FIG. 1 showing a step in folding the garment.

As a result, the torso portion 12 is inside-out, whereby the inner surface 18 of the torso portion 12 faces outward and the outer surface 20 of the torso portion 12 faces inward, as shown in FIG. 9. The edges of the opening 24 continue to be pulled in the direction of arrows H until the sleeve portions 14 and the leg portions 16 are folded within the garment 10, as shown in FIG. 10. At this point, the torso portion 12 essentially forms a satchel with an inner space containing the sleeve portions 14 and the leg portions 16. The torso portion 12 has its inner surface 18 facing outward, but the outer surface 20 of the sleeve portions 14 and leg portions 16 continue to face outwardly within the torso portion 12. Preferably, the sleeve portions 14 and the leg portions 16 are fully extended within the torso portion 12. Because the inner surface 18 of the garment 10 faces outward, the outer surface 20 of the garment 10 is protected from contamination.

As further shown in FIG. 10, the sleeve portions 14 and the leg portions 16 have internal openings that receive the arms and legs of the wearer. The arm and leg opening are accessed through arm accesses 26 and leg accesses 28, respectively. The arm accesses 26 to the sleeve portions 14 and the leg accesses 28 to the leg portions 16 are substantially at an outer peripheral edge of the folded garment 10 so that the wearer has easy access to the arm and leg openings when donning the garment.

Figure 11:
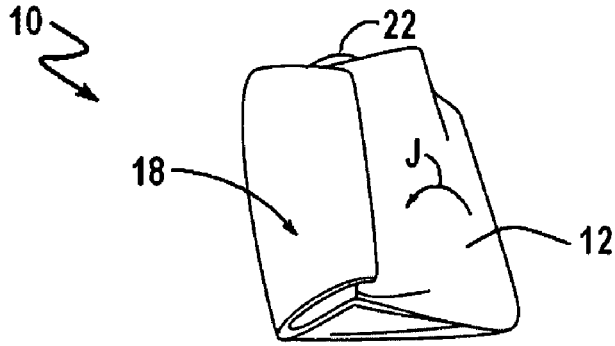
FIG. 11 is a perspective view of the garment illustrated in FIG. 1 showing a step in folding the garment.
Figure 12:
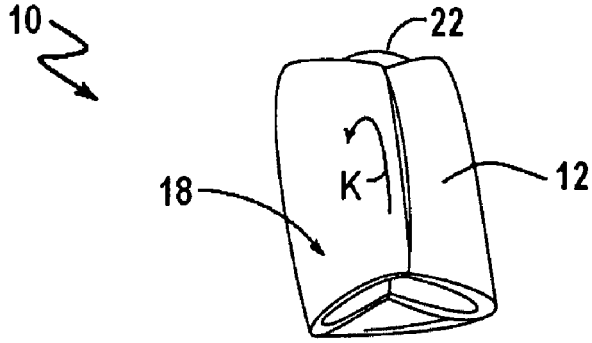
FIG. 12 is a perspective view of the garment illustrated in FIG. 1 showing a step in folding the garment.
Figure 13:
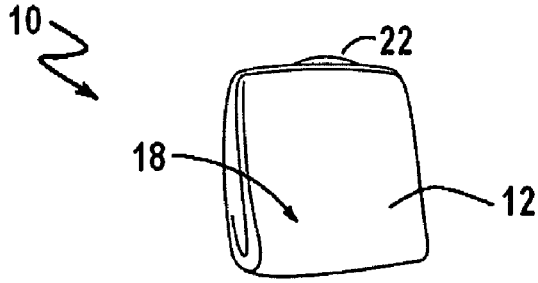
FIG. 13 is a perspective view of the garment illustrated in FIG. 1 showing a step in folding the garment.

Then, the garment 10 is folded further so that it fits a particular packaging. The garment 10 also can optionally be folded so that the inner surface 18 of the collar portion 22 protrudes prominently from the folded garment 10 so that the wearer can easily find and grasp the inner surface 18 of the collar portion 22. In one exemplary embodiment, the garment 10 is folded in the direction of arrow I, as shown in FIG. 10; then in the direction of arrow J, as shown in FIG. 11; and finally in the direction of arrow K, as shown in FIG. 12. Consequently, as shown in FIG. 13, the garment 10 is prepared to be placed in a bag, and the collar portion 22 protrudes from the folded garment 10 to provide the wearer with an obvious grasp for handling the folded garment 10 after opening the bag.

Although the garment 10 can be folded in any environment, to minimize contamination, the garment 10 is preferably folded in a Class 100 clean room. The garment 10 is also treated to remove contaminants. The removal of contaminants may be done before or after the garment 10 is folded. The treatment can be by irradiation, chemical treatment, brushing, wiping, scouring, and other similar methods of removing particulate matter, microorganisms, or chemical contaminants. Preferably, the garment 10 is treated by irradiation after it is folded and bagged.

Figure 14:
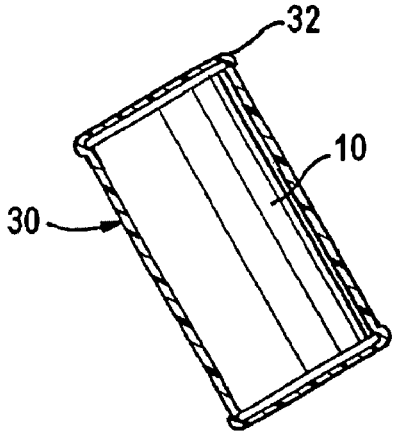
FIG. 14 is a sectional view of a bag enclosing the garment illustrated in FIG. 1.
Figure 15:
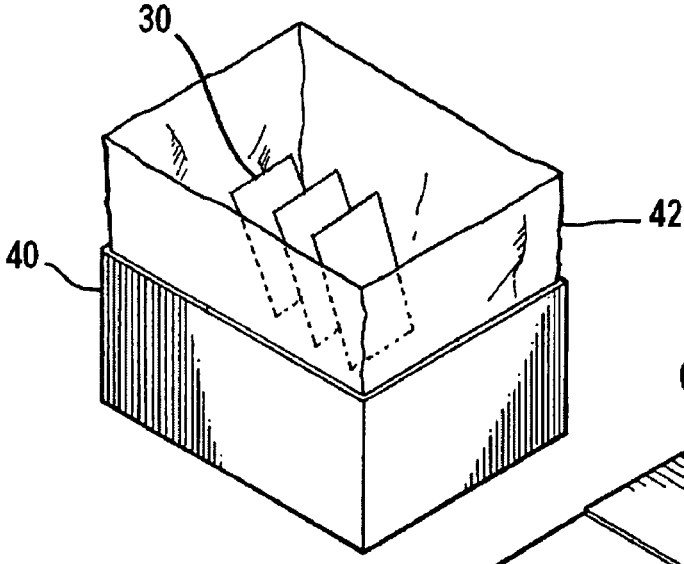
FIG. 15 is a perspective view of a carton containing the bags illustrated in FIG. 14.

Referring to FIG. 14, once the garment 10 is folded, it is inserted into a bag 30 so that the garment 10 stays uncontaminated after it is irradiated. The bag 30 has one open end which can be sealed. The bag 30 may be formed of a plastic composition of the closed cell type and in particular may be formed of a polyethylene composition. Once the garment 10 has been placed in the bag 30, the bag 30 is heat sealed to form a substantially hermetic seal 32, as shown in FIG. 14. Once the bag 30 has been heat sealed, the bag 30 is then inserted into a lined carton 40 as shown in FIG. 15. The carton 40 may be a cardboard type container adaptable for transportation and associated shipping. Though a sealing layer 42 is not required, one may be provided to line the carton 40 depending on the application. The sealing layer 42 may be formed of a plastic type composition of the closed cell type which may also be a polyethylene composition. The sealing layer 42 lines the internal walls of the carton 40 in order to receive one or a plurality of bags 30 therein. The sealing layer 42 may then be closed through tying or some like closure mechanism and in this manner the one or plurality of bags 30 is then contained therein. Finally, the carton 40 may be closed by flap closures.

Figure 16:
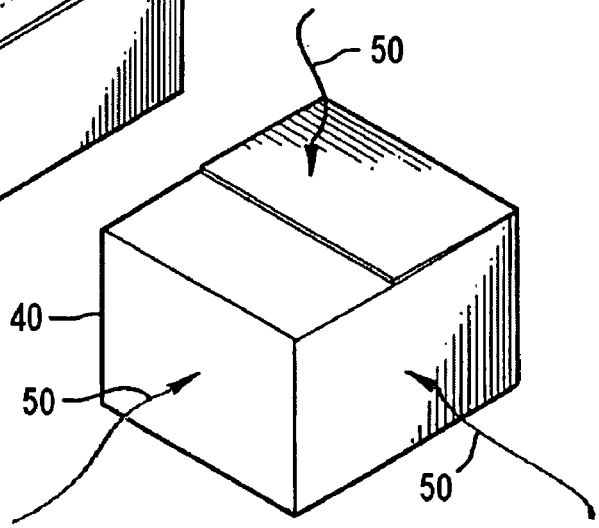
FIG. 16 is a perspective view of the carton illustrated in FIG. 15 being irradiated.

Referring to FIG. 16, once the bags 30 have been inserted into the carton 40, the carton 40 is then irradiated. The irradiation may be completed by a gamma irradiation system in accordance with well-known techniques, such as in U.S. Pat. No. 6,123,900 to Vellutato, issued Sep. 26, 2000, the entire disclosure of which is incorporated herewith. In general, the cartons 40 are brought to an irradiation plant for irradiation. Gamma radiation is generally used for sterilization because gamma radiation has a high penetration capability. This high penetration capability enables products to be processed easily.

The closed cartons 40 are then prepared for shipping and are transported. When received, the closed cartons 40 may be opened and the bags 30 removed from the carton 40 so that the bags 30 can be stored, for example, in a dressing room located immediately adjacent to a clean room or some other site. If the carton 40 is lined with the sealing layer 42, the carton 40 and the sealing layer 42 would be opened to remove the bags 30. Alternatively, the sealing layer 42 can be removed from the carton 40, and the bags 30 maintained within the sealing layer 42 in a closed manner until the sealing layer 42 is moved to the clean room, a room adjacent to the clean room, or some other site. Once removed from the carton 40 or the sealing layer 42, the bag 30 encompassing the garment 10 is available for use.

Accordingly, when the bag 30 is opened, the inner surface 18 of the garment 10 is facing outward and exposed to the wearer, substantially similar to the folded condition shown in FIG. 13. Then, the wearer can grab the garment 10 easily by its inner surface 18 without contaminating the outer surface 20 of the garment 10. In addition, because the inner surface 18 of the collar portion 22 may be protruding out beyond the rest of the garment 10, the wearer can easily grab the garment 10 by the inner surface 18 of the collar portion 22, if desired.

To don the garment 10, the wearer removes the garment 10 from the bag 30. Since the inner surface 18 of the garment 10 is facing outward, the wearer necessarily handles the garment 10 by the inner surface 18. After the wearer removes the garment 10 from the bag 30, the wearer unfolds the garment 10 until the garment 10 largely returns to the folded condition shown in FIG. 10 in which the arm accesses 26 and the leg accesses 28 are on the outer peripheral edge of the folded garment 10. At this point, the leg accesses 28 to the openings in the leg portions 16 are easily accessible. To don the garment 10, the wearer holds the garment 10 by its corners X (shown in FIG. 10), and the wearer thrusts one leg into one of leg accesses 28 to one leg portion 16. Next, while still grasping the corners X (shown in FIG. 10), the wearer thrusts his other leg into the other leg access 28 for the other leg portion 16. Because the leg portions 16 are fully extended within the torso portion 12, the wearer's legs can be easily inserted into the leg portions 16.

Figure 17:
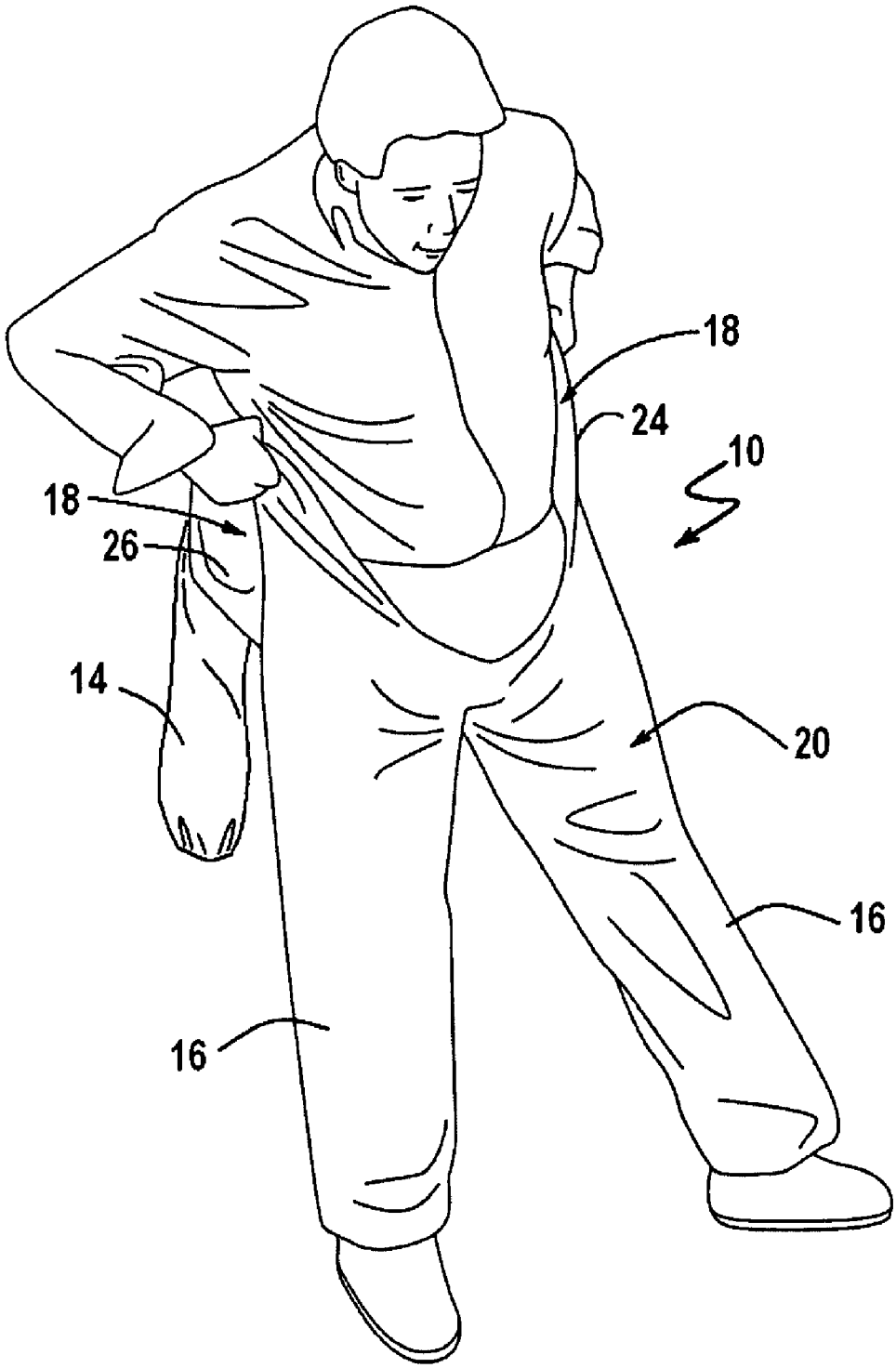
FIG. 17 is a perspective view of a wearing donning the garment illustrated in FIG. 1.

Referring to FIG. 17, the wearer has inserted his legs into the leg portions 16 and the wearer has optionally pulled the garment 10 up, as shown, by grabbing an interior surface of the garment. Once the wearer's legs are in the leg portions 16, the sleeve portions 14 hang down behind the wearer. The wearer then reaches down to insert one arm into one of the arm accesses 26 of a sleeve portion 14. The wearer can simply slide an arm into one of the sleeve portions 14 which stays in place by virtue of the leg portions 16 operating against the wearer's body. Or, the wearer can grasp the garment 10 by holding its inner surface 18 to further facilitate the arm being inserted into the sleeve portion 14. After inserting one arm into one of the sleeve portions 14, the torso portion 12 largely covers the torso of the wearer, and the other sleeve portion 14 is more reachable. The wearer then inserts his other arm into the other arm access 26 for the other sleeve portion 14, and the wearer finishes pulling the torso portion 12 over his torso. Afterwards, the outer surface 20 of the garment 10 faces outward, and the wearer can then close the opening 24.

If hoods, gloves, and boots are required, the hoods, gloves, and boots can be provided in separate bags 30. Alternatively, the hood, gloves, and boots can be provided in the same bag 30 with the garment 10. The hood, gloves, boots, or some combination thereof can be integral with or attached to the garment 10. If the hood is attached to or integral with the garment 10, the hood is folded with its inner surface facing outward. If the glove is attached to or integral with the sleeve portion 14, the sleeve portion 14 is folded as described above. If the boot is attached to or integral with the leg portion 16, the leg portion 16 is folded as described above.

As apparent from the foregoing description, according to an exemplary embodiment of the present invention, the garment is folded so that the wearer handles the garment by its inner surface thus preventing contamination of its outer surface. The garment is also folded to facilitate the donning of the garment while preventing contamination of its outer surface. Furthermore, extensive training for donning the garment is not required. The garment used in the invention is preferably a lightweight disposable garment.

While a particular embodiment has been chosen to illustrate the invention, it will be understood by those skilled in the art that various changes and modifications can be made therein without departing from the scope of the invention as defined in the appended claims.

What is claimed is:

1. A packaged garment, comprising:

a garment having a torso portion with an outer surface and an inner surface opposite the outer surface, sleeve portions coupled to the torso portion with accesses for receiving a user's arms, and leg portions coupled to the torso with accesses for receiving the user's legs; and a sealed bag containing the garment folded so that the sleeve portions and the leg portions are disposed over the torso portion, the inner surface of the torso portion faces outward and the outer surface forms an inner space containing the sleeve portions and the leg portions, and the accesses of the sleeve portions and the accesses of the leg portions are accessible and unobstructed at peripheral edges of the inner space.

2. The packaged garment of claim 1, wherein the garment further comprises a collar portion.

3. The packaged garment of claim 2, wherein the garment in the sealed bag is folded so the collar portion protrudes.

4. The packaged garment of claim 1, wherein the sleeve and leg portions are folded within the inner space.

5. The packaged garment of claim 1, wherein the outer surface of the sleeve portion faces outward.

6. The packaged garment of claim 1, wherein the outer surface of the leg portions faces outward.

7. The packaged garment of claim 1, wherein the sealed bag is irradiated at a predetermined irradiation level for a predetermined time interval.

8. The packaged garment of claim 1, wherein the garment comprises a coverall.

9. A method of manufacturing a packaged garment having an outer surface, an inner surface opposite the outer surface, a torso portion, two sleeve portions coupled to the torso portion at respective arm accesses, and two leg portions coupled to the torso portion at respective leg accesses, the method of manufacturing comprising the steps of:

folding the two sleeve portions onto the torso portion;

folding the two leg portions onto the torso portion;

manipulating the folded garment so that the inner surface of the torso portion faces outward and the outer surface forms an inner space with the two sleeve portions and the two leg portions disposed therein, and the accesses of the two sleeve portions and the accesses of the two leg portions are accessible and unobstructed at peripheral edges of the inner space; and sealing the folded garment in a bag.

10. The method of manufacturing according claim 9, further comprising the step of sterilizing the garment and the bag.

11. The method of manufacturing according to claim 10, wherein the step of sterilizing is by irradiation.

12. The method of manufacturing according to claim 10, wherein the step of sealing the folded garment in the bag includes hermetically sealing the bag.

13. The method of manufacturing according to claim 10, wherein the step of sealing the folded garment in the bag includes heat sealing the bag.

14. The method of manufacturing according to claim 10, further comprising the step of disposing the bag in a shipping container.

15. The method of manufacturing according to claim 10, further comprising the steps of:

disposing the bag in a sealing layer; and disposing the sealing layer in a shipping container.

16. The method of manufacturing according to claim 9, wherein the outer surface of the sleeve portions and the leg portions face outward.

17. The method of manufacturing according to claim 9, further comprising the step of fully extending the sleeve portions and the leg portions within the torso portion.

18. The method of manufacturing according to claim 9, further comprising the step of arranging the arm accesses and the leg accesses to lie substantially at an outer peripheral edge of the folded garment.

19. A method of manufacturing a packaged uncontaminated garment having an outer surface, an inner surface opposite the outer surface, a torso portion with an opening, sleeve portions coupled to the torso portion at respective arm accesses, and leg portions coupled to the torso portion at respective leg accesses, the method of manufacturing comprising the steps of:

folding the sleeve portions onto the torso portion;

folding the leg portions onto the torso portion over the sleeve portions;

manipulating the opening of the torso portion over the folded sleeve portions and leg portions so that the inner surface of the torso portion faces outward and the outer surface forms an inner space with the sleeve portions and the leg portions disposed therein and the outer surface of the sleeve portions and the leg portions face outward within the inner space;

fully extending the sleeve portions and the leg portions within the inner space;

arranging arm accesses and leg accesses to lie substantially at an outer peripheral edge of the inner space so the arm accesses and leg accesses are accessible and unobstructed at the outer peripheral edge of the inner space; and sealing the folded garment in a bag.

20. The method of manufacturing according to claim 19, further comprising the steps of:

folding the garment to be disposed in the bag;

hermetically sealing the bag;

disposing the sealed bag in a carton; and irradiating the garment, the bag, and the carton externally at a predetermined level for a predetermined time interval.

21. The method of manufacturing according to claim 19, wherein the step of disposing the sealed bag in a carton further comprises the steps of:

disposing the bag in a sealing layer;

closing the sealing layer; and disposing the sealing layer in a carton.

22. The packaged garment of claim 1, wherein the sealed bag is a hermetically sealed bag.

23. The packaged garment of claim 1, wherein the sealed bag is a heat sealed bag.

24. The packaged garment of claim 1, further comprising a shipping container receiving the sealed bag and garment to form a non-sterile closed shipping package wherein the closed shipping package is externally radiated to sterilize the garment.

25. The packaged garment of claim 1, wherein at least one of the garment and the sealed bag is sterilized by irradiation.

26. The packaged garment of claim 1, wherein the leg portions are folded no more than once onto the torso portion.

27. The packaged garment of claim 1, wherein the garment has a longitudinal axis and each of the sleeve portions has a longitudinal axis; and the sleeve portions are folded such that the longitudinal axis of each of the sleeve portions is substantially parallel to the longitudinal axis of the garment.

28. The packaged garment of claim 27, wherein each of the leg portions has a longitudinal axis; and the leg portions are folded over onto a the arm portions such that the longitudinal axis of each of the leg portions is substantially parallel to the longitudinal axis of the garment.

29. The packaged garment of claim 1, wherein the garment comprises a garment worn in a clean room.

30. A packaged garment, consisting of:

a clean room coverall garment having a torso portion with an outer surface and an inner surface opposite the outer surface, sleeve portions coupled to the torso portion with accesses for receiving a user's arms, and leg portions coupled to the torso with accesses for receiving the user's legs; and a sealed bag containing a folded garment, the folded garment being the clean room coverall garment with the sleeve portions and the leg portions folded over the torso portion and at least part of the torso portion folded around the sleeve portions and the leg portions so that the inner surface of the folded portion of the torso portion faces outward, thereby forming an inner space within the torso portion that encloses the sleeve portions and the leg portions with the accesses of the sleeve portions and the accesses of the leg portions accessible and unobstructed at peripheral edges of the inner space.

31. The packaged garment of claim 30, wherein the leg portions are folded no more than once onto the torso portion.

32. The packaged garment of claim 30, wherein the garment has a longitudinal axis and each of the sleeve portions has a longitudinal axis, and the sleeve portions are folded such that the longitudinal axis of each of the sleeve portions is substantially parallel to the longitudinal axis of the garment.

33. The packaged garment of claim 32, wherein each of the leg portions has a longitudinal axis; and the leg portions are folded over onto a the arm portions such that the longitudinal axis of each of the leg portions is substantially parallel to the longitudinal axis of the garment.

34. The packaged garment of claim 3, wherein the peripheral edges at which the accesses of the sleeve portions are accessible are folded toward a central portion of the garment; and the peripheral edges at which the accesses of the leg portions are accessible are folded toward the collar so that the collar portion remains protruding from the garment with the garment sealed in the bag.

35. The packaged garment of claim 30, wherein the garment further comprises a collar portion;

the peripheral edges at which the accesses of the sleeve portions are accessible are folded toward a central portion of the garment; and the peripheral edges at which the accesses of the leg portions are accessible are folded toward the collar so that the collar portion remains protruding from the garment with the garment sealed in the bag.

36. The packaged garment of claim 1, wherein each of the leg portions is configured to wrap around and separately cover one of the user's legs.

* * * * *